US011027214B2

(12) United States Patent
Tikhonenko

(10) Patent No.: US 11,027,214 B2
(45) Date of Patent: Jun. 8, 2021

(54) MAGNETIC CONSTRUCTION TOY

(71) Applicant: Dragon'S Egg, Ltd, London (GB)

(72) Inventor: Artur Georgievich Tikhonenko, Minsk (BY)

(73) Assignee: DRAGON'S EGG, LTD, London (GB)

( * ) Notice: Subject to any disclaimer, the term of this patent is extended or adjusted under 35 U.S.C. 154(b) by 0 days.

(21) Appl. No.: 16/609,341

(22) PCT Filed: Apr. 20, 2018

(86) PCT No.: PCT/IB2018/000406

§ 371 (c)(1),
(2) Date: Oct. 29, 2019

(87) PCT Pub. No.: WO2018/197941

PCT Pub. Date: Nov. 1, 2018

(65) Prior Publication Data

US 2020/0054956 A1 Feb. 20, 2020

(30) Foreign Application Priority Data

Apr. 29, 2017 (BY) ..... u20170176

(51) Int. Cl.
*A63H 33/26* (2006.01)
*A63H 33/04* (2006.01)

(52) U.S. Cl.
CPC ..... *A63H 33/046* (2013.01); *A63H 33/26* (2013.01)

(58) Field of Classification Search
CPC ..... A63H 33/00; A63H 33/046; A63H 33/26; A63H 33/042; A63H 33/086; A63H 33/10
USPC ..... 446/92, 117, 118, 120, 129, 137–139
See application file for complete search history.

(56) References Cited

U.S. PATENT DOCUMENTS 5,009,480 A * 4/1991 Okada ..... G01C 19/726 356/464
6,017,220 A * 1/2000 Snelson ..... A63H 33/046 434/211
6,749,480 B1 * 6/2004 Hunts ..... A63H 33/046 446/85
2014/0357151 A1 * 12/2014 Worley ..... A63H 33/046 446/92

* cited by examiner

*Primary Examiner* — Kien T Nguyen
(74) *Attorney, Agent, or Firm* — Inventa Capital PLC

(57) ABSTRACT

Magnetic construction toy refers to engaging games and may be used to assemble three-dimensional figures. The magnetic construction toy contain elements in the form of polyhedrons with magnets placed inside each face and the elements are made in the form of tetrahedron, or octahedron, or cube, or other similar forms.

4 Claims, 5 Drawing Sheets

MAGNETIC CONSTRUCTION TOY

RELATED APPLICATIONS

The present application claims priority to Belorussian patent application number u 20170176 filed on Apr. 29, 2017 and Patent Cooperation Treaty application number PCT/J B2018/000406 filed on Apr. 18, 2018 and incorporated by reference herewith in its entirety.

RELATED ART

The present invention relates to a magnetic construction toy for engaging games and may be used to assemble three-dimensional figures.

BACKGROUND OF THE INVENTION

The state of art shows that there are construction toys containing magnetic elements inside modules. The closest equivalents are as follows. Wooden magnetic construction toy consisting of elements in the form of three-dimensional geometric figures with magnets located inside certain faces thereof.

Not all the faces of figures contain magnets which prevents using all the element surfaces to assemble different complex structures, while at connection of two elements of the same pole magnetic faces repel one another. Drawbacks of the product are: limited inventory of figures to be assembled, inconvenience in use, complicated use and low playing properties. The closest equivalent of the specified utility model is magnetic building blocks according to the U.S. Pat. No. 7,247,075 consisting of three-dimensional modules made in pyramid shape, each containing magnetic disks, one per each face and two in the bottom. As one magnet is fixed to one face, the same pole magnetic faces repel one another at connection of two elements.

When complicated shapes are assembled the form loses its stability due to a magnet located approximately in the middle of the face and no fixation of edges of the elements by means of magnetic field. Drawbacks of this magnetic building blocks are: the use of one figure type only, as well as number and location of magnets insufficient to provide secure fixation of elements to each other, which reduces the inventory of figures to be assembled with this magnetic construction toy, complicates its use and limits its playing properties.

The task of the proposed utility model is to improve playing properties of magnetic construction toy, expand the inventory of structures assembled with this magnetic construction toy, as well as simplify composition of such structures and ensure stability thereof.

SUMMARY OF THE INVENTION

Magnetic construction toy refers to engaging games and may be used to assemble three-dimensional figures. This is a magnetic construction toy containing elements in the form of polyhedrons with magnets placed inside each face and distinguished by the fact that the elements are made in the form of tetrahedron, or octahedron, or cube, or semi-tetrahedron formed by tetrahedron division into equal parts along the vertical axis, or semi-octahedron formed by octahedron division into equal parts along the vertical axis, or semi-octahedron formed by octahedron division into equal parts along the horizontal axis, or quarter-octahedron formed by division of semi-octahedron formed by octahedron division into lwo equal parts along the horizontal axis into two equal parts along the vertical axis.

In the elements made in the form of tetrahedron, octahedron, cube, as well as semi-tetrahedrons joint into tetrahedron and formed by tetrahedron division into equal parts along the vertical axis, and semi-octahedrons joint into octahedron and made by octahedron division into equal parts along the vertical or horizontal axis, and quarter-octahedrons formed by division of semi-octahedron formed by octahedron division into two equal parts along the horizontal axis into two equal parts along the vertical axis heteropolar magnets are pairwise and symmetrical towards bisectors of face angles, as well as equally spaced from face edges that are the sides of these angles; magnets are located with polarity alternation.

The elements face edges that are the sides of regular triangles, squares, bottoms of irregular isosceles triangles and hypotenuses of right triangles are equal in length. At the same time, 4 magnets are placed inside each rectangle face in the elements in the form of quarter-octahedron formed by division of semi-octahedron formed by octahedron division into two equal parts along the horizontal axis into two equal parts along the vertical axis. 3 magnets are placed inside each right triangle face in the elements in the form of semi-tetrahedron formed by tetrahedron division into equal parts along the vertical axis, quarter-octahedron formed by division of semi-octahedron formed by octahedron division into two equal parts along the horizontal axis into two equal parts along the vertical axis, as well as semi-octahedron formed by octahedron division into equal parts along the vertical axis.

32 magnets or 8 magnets are placed inside each face of cubic elements; 32 magnets are divided into 4 groups of 8 magnets forming the tops of octagons pairwise symmetrical towards bisectors of face angles, in which case length of cubic element face with 32 magnets placed inside is twice longer than the length of cubic element face with 8 magnets placed inside. 24 magnets or 6 magnets are placed inside each face of octahedron or tetrahedron elements; 24 magnets are divided into 4 groups of 6 magnets forming tops of hexagons located in such a way that 2 groups are divided by face angle bisector into two halves, while 2 other groups are symmetrical towards this bisector; length of octahedron or tetrahedron element face with 24 magnets placed inside is twice longer than the length of octahedron or tetrahedron element face with 6 magnets placed inside.

The magnetic construction toy task is achieved by provision of simplicity of elements comparison and reinforced fixation thereof to each other due to the fact that in magnetic construction toy contains elements in the form of polyhedrons, with magnets placed inside each face. The elements are made in the form of tetrahedron, or octahedron, or cube, or semi-tetrahedron formed by tetrahedron division into equal parts along the vertical axis, or semi-octahedron formed by octahedron division into equal parts along the vertical axis, or semi-octahedron formed by octahedron division into equal parts along the horizontal axis, or quarter-octahedron formed by division of semi-octahedron formed by octahedron division into two equal parts along the horizontal axis into two equal parts along the vertical axis.

The elements are made in the form of tetrahedron, octahedron, cube, as well as semi-tetrahedrons joint into tetrahedron and formed by tetrahedron division into equal parts along the vertical axis, and semi-octahedrons joint into octahedron and formed by octahedron division into equal parts along the vertical or horizontal axis, and quarter-octahedrons formed by division of semi-octahedron formed by octahedron division into two equal parts along the horizontal axis into two equal parts along the vertical axis. Heteropolar magnets are pairwise and symmetrical towards bisectors of face angles, as well as equally spaced from face edges that are the sides of these angles; magnets are located with polarity alternation; the elements face edges that are the sides of regular triangles, squares, bottoms of irregular isosceles triangles and hypotenuses of right triangles are equal in length.

BRIEF DESCRIPTION OF THE DRAWINGS

Substance of the utility model is explained by the following graphical images with schematic location of magnets inside the faces of the elements.

DETAILED DESCRIPTION OF THE INVENTION

Figure 1:
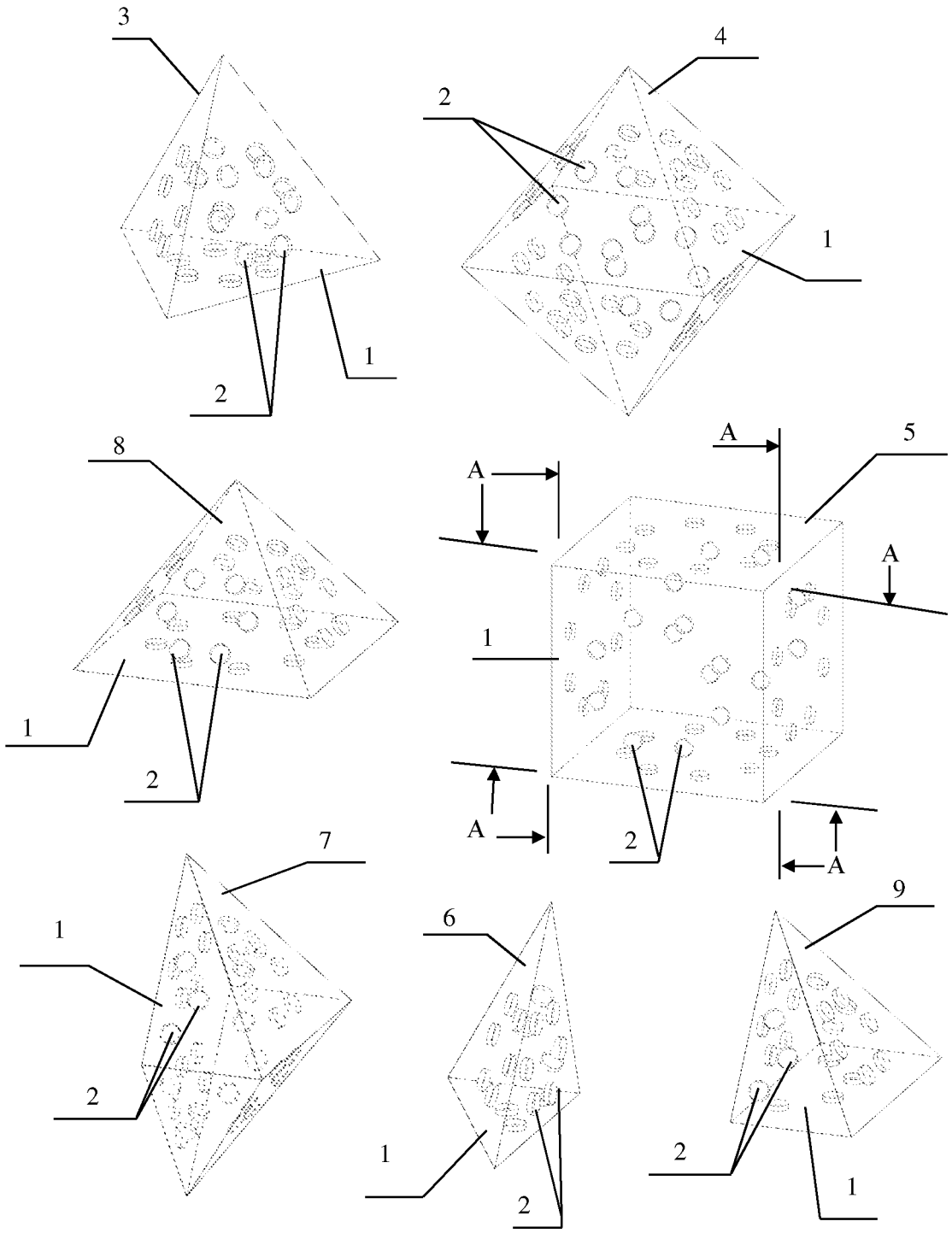
FIG. 1 illustrates a general view of a magnetic construction toy.
Figure 2:
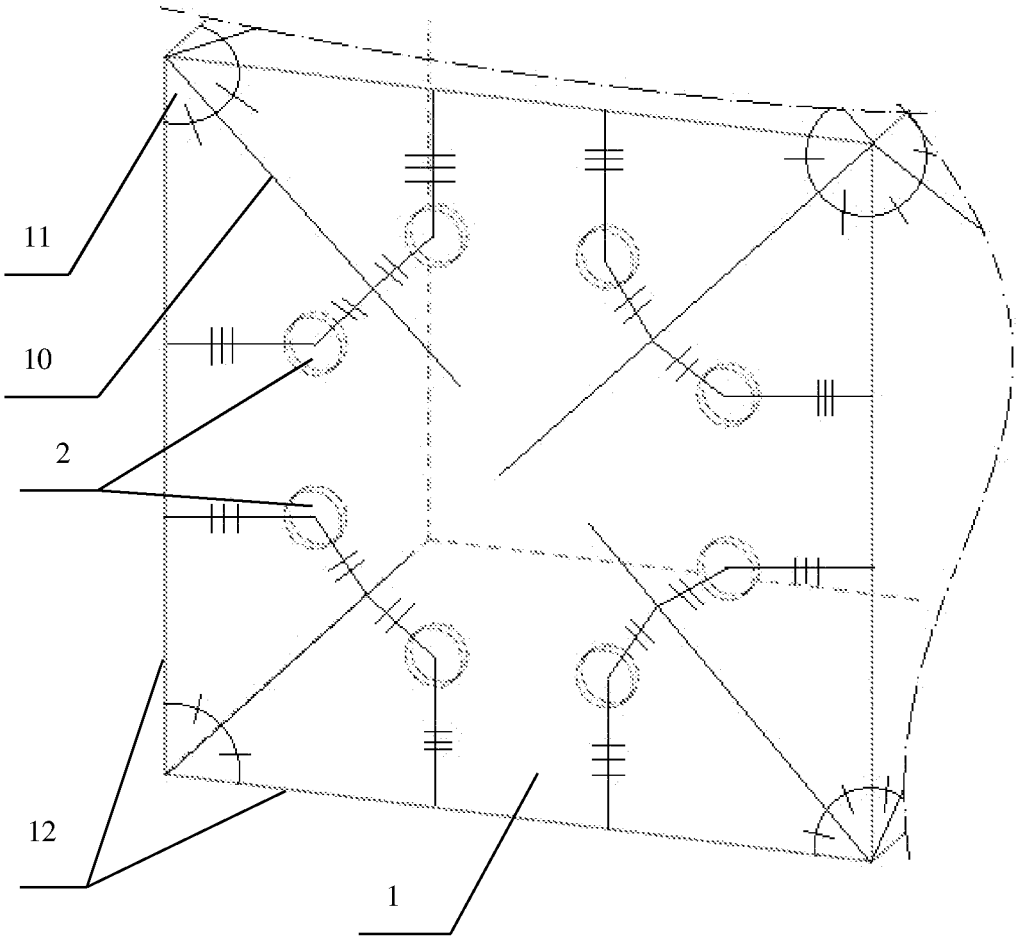
FIG. 2 illustrates view taken along lines A-A-A-A.
Figure 3:
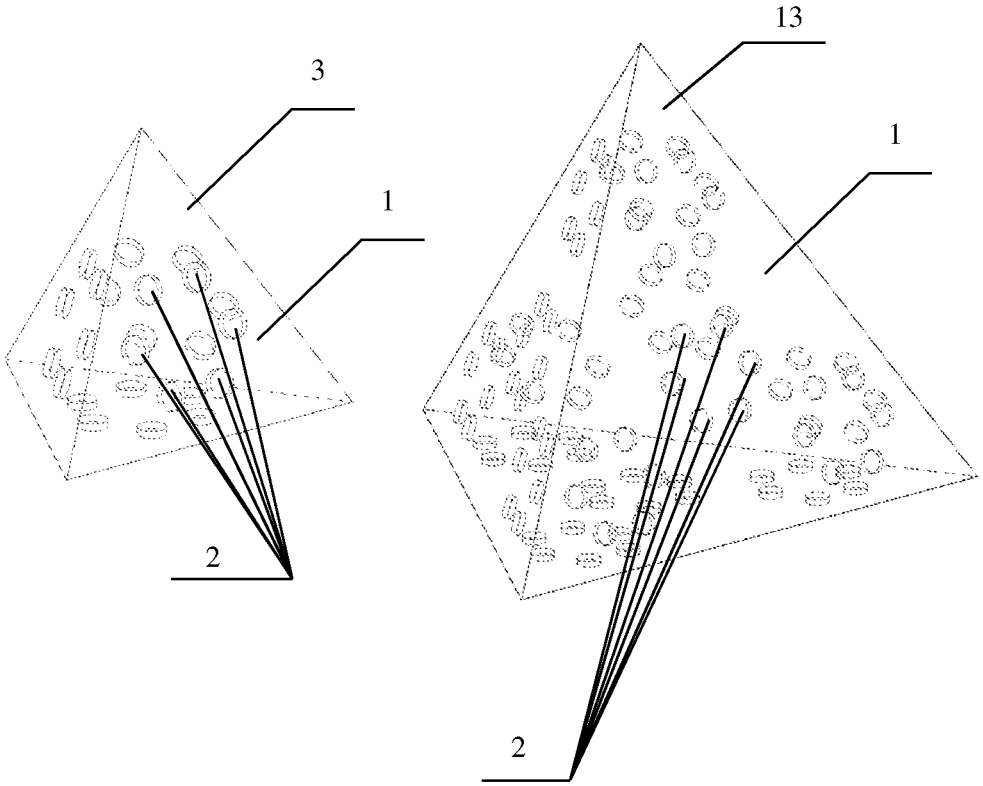
FIG. 3 illustrates a general view of the magnetic construction toy elements made in the form of tetrahedron.
Figure 4:
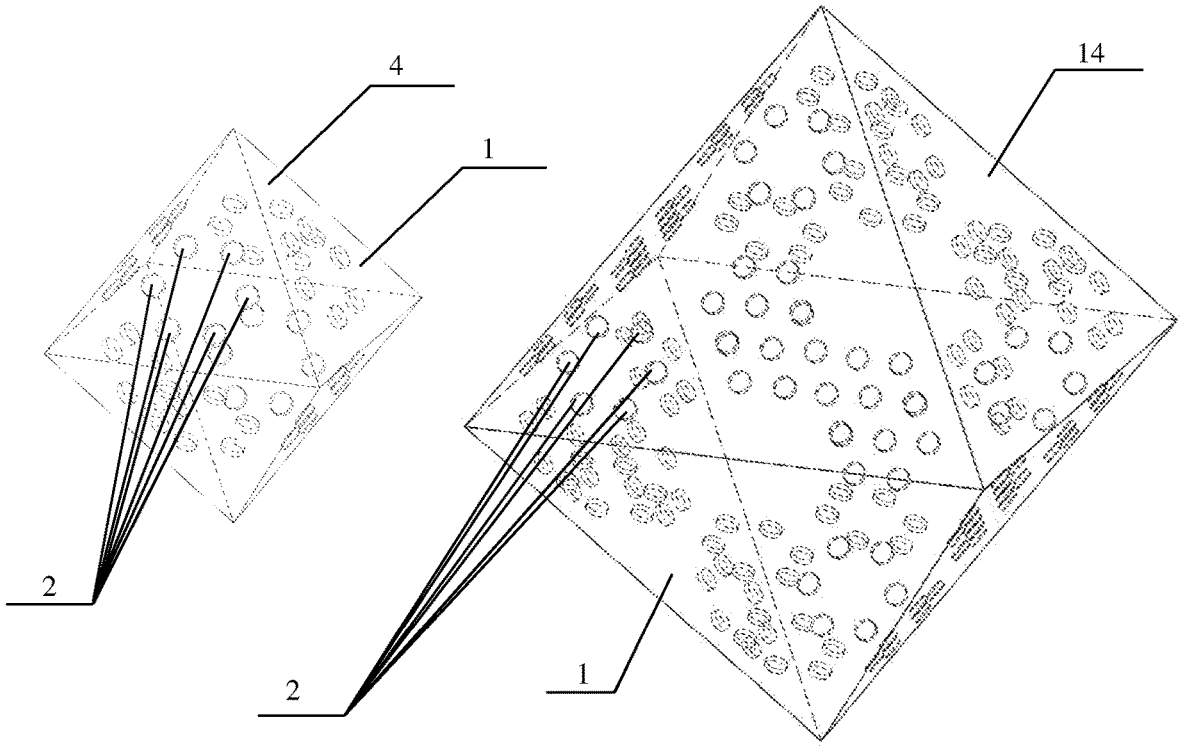
FIG. 4 illustrates a general view of the magnetic construction toy elements made in the form of octahedron.
Figure 5:
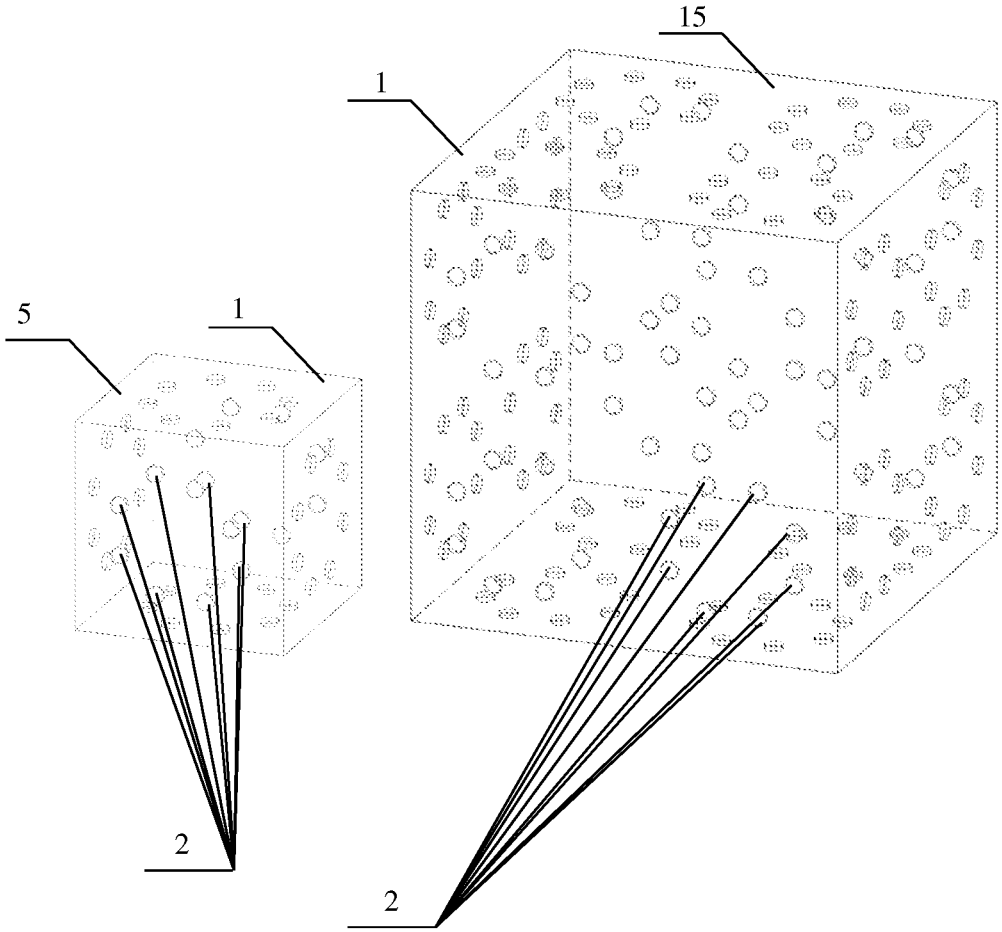
FIG. 5 illustrates a general view of the magnetic construction toy elements made in the form of cube.

Magnets are located with polarity alternation; the elements face edges that are the sides of regular triangles, squares, bottoms of irregular isosceles triangles and hypotenuses of right triangles are equal in length.

At the same time, in the elements in the form of quarter-octahedron formed by division of semi-octahedron formed by octahedron division into two equal parts along the horizontal axis into two equal parts along the vertical axis, 4 magnets can be placed inside each rectangular face; in the elements in the form of semi-tetrahedron formed by tetrahedron division into equal parts along the vertical axis, quarter-octahedron formed by division of semi-octahedron formed by octahedron division into two equal parts along the horizontal axis into two equal parts along the vertical axis, as well as semi-octahedron formed by octahedron division into two equal parts along the vertical axis, 3 magnets can be placed inside each triangle face; in cubic elements inside each face 32 magnets or 8 magnets can be placed; 32 magnets are divided into 4 groups of 8 magnets forming tops of octagons pairwise symmetrical towards bisectors of face angles; length of cubic element face with 32 magnets placed inside may be twice longer than the length of cubic element face with 8 magnets placed inside; in octahedron or tetrahedron elements 24 magnets or 6 magnets can be placed inside each face; 24 magnets are divided into 4 groups of 6 magnets forming tops of hexagons located in such a way that 2 groups are divided by face angle bisector into two halves, while 2 other groups are symmetrical towards this bisector; length of octahedron or tetrahedron element face with 24 magnets placed inside may be twice longer than the length of octahedron or tetrahedron element face with 6 magnets placed inside.

The magnetic construction toy contains elements in the form of polyhedrons with magnets 2 placed inside each face 1. Distinctive feature of the specified utility model is execution of elements in the form of tetrahedron 3, or octahedron 4, or cube 5, or semi-tetrahedron 6 formed by tetrahedron division into equal parts along the vertical axis, or semi-octahedron 7 formed by octahedron division into equal parts along the vertical axis, or semi-octahedron 8 formed by octahedron division into equal parts along the horizontal axis, or quarter-octahedron 9 formed by division of semi-octahedron formed by octahedron division into two equal parts along the horizontal axis into two equal parts along the vertical axis; location, in the elements in the form of tetrahedron 3, octahedron 4, cube 5, as well as in semi-tetrahedrons 6 joint into tetrahedron 3 and formed by tetrahedron 3 division into equal parts along the vertical axis and, and in semi-octahedrons 7 and 8, respectively, joint into octahedron 4 and made by octahedron 4 division into equal parts along the vertical or horizontal axis, and in quarter-octahedrons 9 formed by division of semi-octahedron 8 formed by octahedron 4 division into two equal parts along the horizontal axis into two equal parts along the vertical axis, of heteropolar magnets 2 pairwise and symmetrical towards bisectors 10 of angles 11 of faces 1, as well as equally spaced from edges 12 of faces 1 which are the sides of these angles 11; location of magnets 2 with polarity alternation; length equality of elements face edges that are the sides of regular triangles, squares, bottoms of irregular isosceles triangles and hypotenuses of right triangles.

Technical result achieved by implementation of the specified utility model consists in expansion of inventory of structures formed by the magnetic construction toy, improvement of their esthetic properties and stability improvement, simplification of elements connection and provision of their secure fixation to each other.

The magnetic construction toy is used in the following way. The elements are connected by contact of faces, in which case they align by themselves against each other along the edges by magnetic field. In the priority use version the magnetic construction toy consists of elements in the form of tetrahedron, or octahedron, or cube, or semi-tetrahedron formed by tetrahedron division into equal parts along the vertical axis, or semi-octahedron formed by octahedron division into equal parts along the vertical axis, or semi-octahedron formed by octahedron division into two equal parts along the horizontal axis, or quarter-octahedron formed by division of semi-octahedron formed by octahedron division into two equal parts along the horizontal axis into two equal parts along the vertical axis, or any combination of the specified elements.

Faces of the elements are squares, rectangles, regular triangles, isosceles triangles and right triangles, in which case the elements face edges that are the sides of regular triangles, squares, bottoms of irregular isosceles triangles and hypotenuses of right triangles are equal in length. Cubic elements are presented in two size versions—32 magnets or 8 magnets can be placed inside each face; 32 magnets are divided into 4 groups of 8 magnets forming the tops of octagons pairwise symmetrical towards bisectors of face angles, in which case length of cubic element face with 32 magnets placed inside may be twice longer than the length of cubic element face with 8 magnets placed inside.

The elements in the form octahedron or tetrahedron are also given in two size versions—24 magnets or 6 magnets are placed inside each face, 24 magnets are divided into 4 groups of 6 magnets forming tops of hexagons located in such a way that 2 groups are divided by face angle bisector into two halves, while 2 other groups are symmetrical towards this bisector; length of octahedron or tetrahedron element face with 24 magnets placed inside is twice longer than the length of octahedron or tetrahedron element face with 6 magnets placed inside. Magnets closest to each other located inside one face are placed with polarity alternation.

In the specified size versions, any faces of any elements are comparable and complementary. Assembled structures have strong bonding which makes them stable.

While the invention has been described as an example embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A magnetic construction toy comprising; elements in the form of polyhedrons with magnets placed inside each face and distinguished by the elements made in the form of at least one of tetrahedron, octahedron, cube, semi-tetrahedron formed by a tetrahedron division into equal parts along a vertical axis, or a semi-octahedron formed by a octahedron division into equal parts along the vertical axis, or a semi-octahedron formed by a octahedron division into equal parts along a horizontal axis, or a quarter-octahedron formed by division of semi-octahedron formed by octahedron division into two equal parts along the horizontal axis into two equal parts along the vertical axis; in the elements made in the form of tetrahedron, octahedron, cube, as well as in semi-tetrahedrons joint into tetrahedron and formed by tetrahedron division into equal parts along the vertical axis, and in semi-octahedrons joint into octahedron and formed by octahedron division into equal parts along at least one of the vertical axis and the horizontal axis, and in quarter-octahedrons formed by division of semi-octahedron formed by octahedron division into two equal parts along the horizontal axis into two equal parts along the vertical axis heteropolar magnets are located pairwise and symmetrical towards bisectors of face angles, as well as equally spaced from face edges that are the sides of these angles; magnets are located with polarity alternation; the elements face edges that are the sides of regular triangles, squares, bottoms of irregular isosceles triangles and hypotenuses of right triangles are equal in length; and including 4 magnets placed inside each rectangle face in the elements in the form of quarter-octahedron formed by division of semi-octahedron formed by octahedron division into two equal parts along the horizontal axis into two equal parts along the vertical axis.

2. The magnetic construction toy as set forth in claim 1, including 3 magnets placed inside each right triangle face in the elements in the form of semi-tetrahedron formed by tetrahedron division into equal parts along the vertical axis, quarter-octahedron formed by division of semi-octahedron formed by octahedron division into two equal parts along the horizontal axis into two equal parts along the vertical axis, as well as semi-octahedron formed by octahedron division into equal parts along the vertical axis.

3. The magnetic construction toy as set forth in claim 1, including 32 magnets or 8 magnets placed inside each face of cubic elements 32 magnets are divided into 4 groups of 8 magnets forming the tops of octagons pairwise symmetrical towards bisectors of face angles, in which case length of cubic element face with 32 magnets placed inside is twice longer an the length of cubic element face with 8 magnets placed inside.

4. The magnetic construction toy as set forth in claim 1, including 24 magnets or 6 magnets placed inside each face of octahedron or tetrahedron elements; 24 magnets are divided into 4 groups of 6 magnets forming tops of hexagons located in such a way that 2 groups are divided by face angle bisector into two halves, while 2 other groups are symmetrical towards this bisector; length of octahedron or tetrahedron element face with 24 magnets placed inside is twice longer than the length of octahedron or tetrahedron element face with 6 magnets placed inside.

* * * * *